United States Patent [19]

Yagihara et al.

[11] Patent Number: 4,659,651

[45] Date of Patent: Apr. 21, 1987

[54] SILVER HALIDE PHOTOGRAPHIC MATERIALS CONTAINING A BLOCKED PHOTOGRAPHIC REAGENT

[75] Inventors: Morio Yagihara; Akihiko Ikegawa, both of Kanagawa, Japan

[73] Assignee: Fuji Photo Film Co., Ltd., Kanagawa, Japan

[21] Appl. No.: 753,847

[22] Filed: Jul. 11, 1985

[30] Foreign Application Priority Data

Jul. 13, 1984 [JP] Japan ..... 59-145593

[51] Int. Cl.[4] ..... G03C 1/46; G03C 1/02

[52] U.S. Cl. ..... 430/542; 430/212; 430/213; 430/214; 430/215; 430/216; 430/217; 430/218; 430/446; 430/543; 430/544; 430/559; 430/564; 430/566; 430/611; 430/613; 430/955; 430/957; 430/959; 430/960

[58] Field of Search ..... 430/955, 957, 959, 960, 430/611, 613, 566, 559, 564, 212–218, 543, 544, 446, 542

[56] References Cited

U.S. PATENT DOCUMENTS

| | | | |
|---|---|---|---|
| 3,961,959 | 6/1976 | Fujiwahra | 430/957 X |
| 4,310,612 | 1/1982 | Mooberry et al. | 430/561 X |
| 4,350,754 | 9/1982 | Bartels-Keith et al. | 430/960 |
| 4,409,323 | 10/1983 | Sato et al. | 430/558 X |
| 4,420,554 | 12/1983 | Ohashi et al. | 430/611 X |
| 4,503,139 | 3/1985 | Bartels-Keith et al. | 430/960 X |
| 4,518,685 | 5/1985 | Yagihara et al. | 430/960 X |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide photographic material comprising a support having thereon at least one light-sensitive silver halide emulsion layer having associated therewith at least one blocked photographic reagent represented by formula (I) or (II);

(I)

(II)

wherein, A represents a moiety of a photographic reagent or a moiety of a precursor of a photographic reagent bonded to the ring containing Z through a hetero atom; $Y^1$, and $Y^2$ and $Y^3$ each represents a hydrogen atom or a substituent, or $Y^1$ and $Y^3$ in formula (I) together form a ring; Z represents an atomic group necessary for forming a carbon ring or a heterocyclic ring; and n represents 1 or 2.

The silver halide photographic material is stable under storage conditions.

21 Claims, No Drawings

SILVER HALIDE PHOTOGRAPHIC MATERIALS CONTAINING A BLOCKED PHOTOGRAPHIC REAGENT

FIELD OF THE INVENTION

This invention relates to a silver halide photographic material, and more particularly to a silver halide photographic material containing a photographically useful photographic reagent having a blocked active group.

BACKGROUND OF THE INVENTION

A photographic technique wherein a photographically useful photographic reagent is previously incorporated in a silver halide photographic material and the effect of the photographic reagent is utilized during processing has different features than a technique using such a photographic reagent by incorporating it in a processing solution. These features are that: (1) a photographic reagent which is easily decomposed by the action of an acid or an alkali or under an oxidizing or reducing condition, and thus cannot be stored in a processing bath for a long period of time, can be effectively utilized; (2) the composition for the processing solution can be simplified and can be easily prepared due to the absence of the photographic reagent in the processing solution; (3) a photographic reagent necessary for a specific photographic layer and/or an adjacent layer to the layer only of a multiplayer photographic material can function for the layer(s) only, and (4) the existing amount of a photographic reagent can be changed as a function of the development of silver halide in a silver halide photographic material.

In this case, however, if a photographic reagent is incorporated in a silver halide photographic material in an active form, the reagent sometimes reacts with other components in the photographic materials or is decomposed by the action of heat, oxygen, etc., during the storage of the photographic material before processing, whereby the expected effect of the photographic reagent cannot be obtained during processing.

As a method of overcoming such a problem, there is a method of blocking the active group of a photographic reagent and incorporating the reagent in a photographic material in a substantially inactive form, that is, incorporating the photographic reagent in a photographic material as a precursor of the reagent. When the photographic reagent is a dye, there is an advantage that by blocking a functional group of a dye having a large influence on the spectral absorption of the dye to shift the spectral absorption thereof to a shorter wavelength side or a longer wavelength side, the reduction in sensitivity by a so-called filter effect does not occur even when the dye exists in a silver halide emulsion layer having the light-sensitive spectral region corresponding to the spectral absorption of the dye.

When the photographically useful photographic reagent is an antifoggant or a development restrainer, the adhesion thereof to light-sensitive silver halides and the desensitizing action thereof by the formation of silver salt during the storage of the photographic material containing the reagent can be restrained by blocking the active group of the photographic reagent, and, at the same time, the incorporation of the photographic reagent in a photographic material has advantages such as that by releasing the photographic reagent from the photographic material with appropriate timing, the formation of fog can be reduced without reducing the sensitivity of the photographic material, the occurrence of overdevelopment fog can be restrained, and/or the development can be stopped at the appropriate time.

When the photographically useful photographic reagent is a developing agent, an auxiliary developing agent, or a fogging agent, there are advantages such as that by blocking the active group or adsorption group of the photographic reagent, the occurrence of various photographically undesirable events, such as the formation of semiquinones or oxidized materials by air oxidation during the storage of the photographic material can be prevented, or the formation of fogged nuclei during storage of the photographic material can be prevented by preventing electron injection into silver halide, which results in stable processing.

When the photographic reagent is a bleach accelerator or a blix accelerator, there are advantages such as that by blocking the active group of the photographic reagent, the occurrence of reactions thereof with other components contained in the photographic material at storage thereof can be restrained, and by releasing the blocking group during processing of the photographic material, the desired effect of the photographic reagent can be utilized at the appropriate time. Groups known in the art by the various terms such as active group, functional group, and adsorption group are commonly referred to herein as "active group".

As described above, the utilization of a precursor for a photographic reagent can be a very effective means for sufficiently exhibiting the performance of the photographic reagent, but, on the other hand, the precursor must meet very severe conditions. That is, the precursor must satisfy the factors, which are somewhat inconsistent with each other, that the precursor stably exists in the photographic material under storage conditions, but that during processing, the blocked group of the photographic reagent is released at the appropriate time to quickly and effectively release the photographic reagent.

Various blocking techniques for photographic reagents are known. For example, there is a method of utilizing a blocking group such as an acyl group, a sulfonyl group, etc., as described in U.S. Pat. No. 3,615,617 (Japanese Patent Publication No. 44,805/72); a method of utilizing a blocking group releasing a photographic reagent by a so-called reverse Michael reaction as described in U.S. Pat. Nos. 3,674,478, 3,791,830, and 4,009,029 (Japanese Patent Publications Nos. 39,727/79, 9696/80 and 34927/80); a method of utilizing a blocking group releasing a photographic reagent with the formation of quinonemethide or a quinonemethide-like compound by the electron transfer in the molecule as described in Japanese Patent Publication No. 39,727/79, Japanese Patent Application (OPI) Nos. 135,944/82, 135,945/82, and 136,640/82 (the term "OPI" indicates an unexamined published patent application open to public inspection); a method of utilizing the intramolecular ring closing reaction as described in Japanese Patent Application (OPI) No. 53330/80; and a method of utilizing the cleavage of a 5-membered or 6-membered ring as described in U.S. Pat. No. 4,335,200 (Japanese Patent Application (OPI) No. 76,541/72) and Japanese Patent Application (OPI) Nos. 135,949/82 and 179,842/82.

However, these known photographic reagents blocked by a blocking group have a problem in that the releasing speed of the photographic reagents cannot be widely controlled, and hence the usable pH range is limited. That is, in the photographic reagent which is stable under storage conditions for the photographic material containing the agent, the releasing speed of the photographic reagent is too low, and processing by a high alkaline processing solution having a pH higher than 12 is required for releasing the reagent; on the other hand, photographic reagents showing a sufficient releasing speed during processing by a processing solution having a pH of 9 to 11 tend to gradually decompose under storage conditions, to reduce the function thereof as the precursor.

SUMMARY OF THE INVENTION

An object of this invention is, therefore, to provide a photographic reagent precursor which is completely stable under storage conditions for the photographic material containing the reagent, and which releases the photographic reagent with appropriate timing during processing.

Another object of this invention is to provide a photographic reagent precursor capable of substantially exhibiting its intended function over a wide pH range.

As a result of extensive investigations, the inventors have discovered that the above-described objects can be attained by a photographic material having at least one light-sensitive silver halide emulsion layer having associated therewith a photographic reagent precursor, wherein the photographic reagent precursor is in the form of a photographic reagent blocked through a hetero atom, as represented by formula (I) or (II)

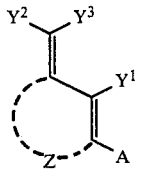

(I)

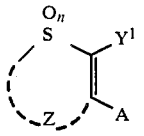

(II)

wherein A represents a moiety of a photographic reagent or a moiety of a precursor thereof bonded to the ring containing Z through a hetero atom; $Y^1$, $Y^2$ and $Y^3$ (which may be the same or different) each represents a hydrogen atom or a substituent or $Y^1$ and $Y^3$ in formula (I) together form a ring; Z represents an atomic group necessary for forming a carbon ring or a heterocyclic ring; and n represents 1 or 2.

DETAILED DESCRIPTION OF THE INVENTION

Of the blocked photographic reagents represented by above-described formulae (I) and (II), preferred reagents are represented by formulae (I') and (II')

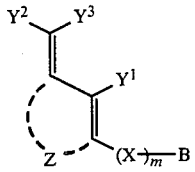

(I')

-continued

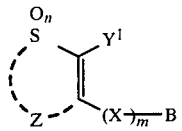

(II')

wherein B represents a moiety of a photographic reagent bonded to X through a hetero atom; X represents a divalent linkage group bonded through a hetero atom to the ring containing Z; m represents 0 or 1; $Y^1$, $Y^2$, and $Y^3$ each represents a hydrogen atom, a halogen atom, an alkyl group, an alkenyl group, an aryl group, an alkoxy group, an aryloxy group, an alkylthio group, an arylthio group, an acyloxy group, a carbonic acid ester group, an amino group, a carbonamido group, a ureido group, a carboxy group, an oxycarbonyl group, a carbamoyl group, an acyl group, a sulfo group, a sulfonyl group, a sulfinyl group, a sulfamoyl group, a cyano group, or a nitro group; and Z represents an atomic group forming a carbocyclic ring or a heterocyclic ring.

The useful moiety of photographic reagent represented by B is a moiety derived from a known photographic reagent having a hetero atom, and is bonded to X through the hetero atom. Specific examples of the photographic reagent are antifoggants and development restrainers such as mercaptotetrazoles, mercaptotriazoles, mercaptopyrimidines, mercaptobenzimidazoles, mercaptoimidazoles, mercaptothiadiazoles, benzotriazoles, indazoles, etc.; developing agents such as p-phenylenediamines, hydroquinones, p-aminophenols, etc.; auxiliary developing agents such as pyrazolidones, etc.; fogging agents such as hydrazines, etc.; silver halide solvents such as thiosulfate, etc.; bleach accelerators such as aminoalkylthiols, etc., and dyes such as azo dyes, etc. Also, the useful photographic reagent may be a photographic reagent having a redox function of releasing the above-described photographic reagent upon a developing reaction of silver halide, such as coloring agents for color diffusion transfer photographic materials and development inhibitor releasing (DIR) hydroquinones.

The above-described moiety of useful photographic reagent represented by B may be bonded to the ring containing Z directly (m=0) or through X (m=1).

X in above-described formulae (I') and (II') represents a divalent linkage group which is bonded to B and the ring containing Z through each of hetero atoms in B and X, repsectively, and is cleaved as X-B during processing to release B. Examples of the hetero atoms include S, O, N, and P.

Examples of such a linkage group are a linkage group (type a) releasing B by an intramolecular ring closing reaction as described in U.S. Pat. No. 4,248,962 (Japanese Patent Application (OPI) No. 145135/79; U.K. Patent Application (unexamined publication) No. 2,010,818 A); a linkage group (type b) releasing B by an intramolecular electron transfer as described in U.S. Pat. No. 4,409,323 (U.K Pat. No. 2,072,363) and U.S. Pat. No. 4,421,845 (Japanese Patent Application (OPI) No. 154,234/82); a linkage group (type c) releasing B with the elimination of carbon dioxide as described in Japanese Patent Application (OPI) No. 179,842/82; and a linkage group (type d) releasing B with the elimination of formaldehyde described in Japanese Patent Application (OPI) No. 93442/84. Structural formulae of some specific examples of X are shown below.

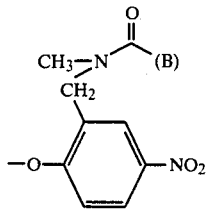

(type a)

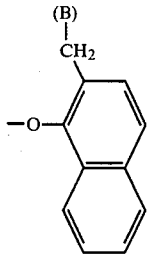

(type b)

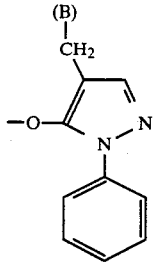

(type b)

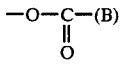

(type c)

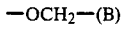

(type d)

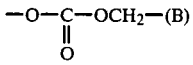

(type c)

$Y^1$, $Y^2$, and $Y^3$ in above-described formulae (I') and (II') each represents a hydrogen atom; a halogen atom (e.g., fluorine, chlorine, bromine, etc.); and alkyl group having, preferably, from 1 to 20 carbon atoms; an aryl group having, preferably, from 6 to 20 carbon atoms; an alkoxy group having, preferably, from 1 to 20 carbon atoms; an aryloxy group having, preferably, from 6 to 20 carbon atoms; an alkylthio group having, preferably, from 1 to 20 carbon atoms; arylthio group having, preferably, from 6 to 20 carbon atoms; an acyloxy group (preferably, HCOO—, an alkylcarbonyloxy group having from 2 to 20 carbon atoms and arylcarbonyloxy group having, from 7 to 20 carbon atoms); an amino group (i.e., an unsubstituted amino group or a secondary or tertiary amino group substituted by, preferably, an alkyl group having from 1 to 20 carbon atoms or an aryl group having from 6 to 20 carbon atoms); a carbonamido group (preferably, a carbonamido group substituted by an alkyl group having from 1 to 20 carbon atoms or an aryl group having from 6 to 20 carbon atoms); a ureido group (preferably, a ureido group substituted by an alkyl group having from 1 to 20 carbon atoms or an aryl group having from 6 to 20 carbon atoms); a carboxy group; a carbonic acid ester group (preferably, a carbonic acid ester group substituted by an alkyl group having from 1 to 20 carbon atoms or an aryl group having from 6 to 20 carbon atoms); an oxycarbonyl group (preferably, an oxycarbonyl group substituted by an alkyl group having from 1 to 20 carbon atoms or an aryl group having from 6 to 20 carbon atoms); a carbamoyl group (preferably, a carbamoyl group substituted by an alkyl group having from 1 to 20 carbon atoms or an aryl group having from 6 to 20 carbon atoms), an acyl group (preferably, HCO—, an alkylcarbonyl group with the alkyl residue having from 1 to 20 carbon atoms or an arylcarbonyl group with the aryl residue having from 6 to 20 carbon atoms); a sulfo group; a sulfonyl group (preferably, a sulfonyl group substituted by an alkyl group having from 1 to 20 carbon atoms or an aryl group having from 6 to 20 carbon atoms); a sulfinyl group (preferably, a sulfinyl group substituted by an alkyl group having from 1 to 20 carbon atoms or an aryl group having from 6 to 20 carbon atoms); a sulfamoyl group (preferably, a sulfamoyl group substituted by an alkyl group having from 1 to 20 carbon atoms or an aryl group having from 6 to 20 carbon atoms); a cyano group; or a nitro group. The alkyl group, alkenyl group and aryl group described above as substituents may have further substituents described with respect to $Y^1$, $Y^2$ and $Y^3$.

The particularly preferred groups shown by $Y^2$ or $Y^3$ are an oxycarbonyl group, a carbamoyl group, an acyl group, a sulfonyl group, a sulfinyl group, a sulfamoyl group, a cyano group, and a nitro group.

Examples of compounds represented by formulae (I) and (II) are illustrated below, but they are not limited thereto. In the following formulae substituents on rings, which are described hereinafter are not shown.

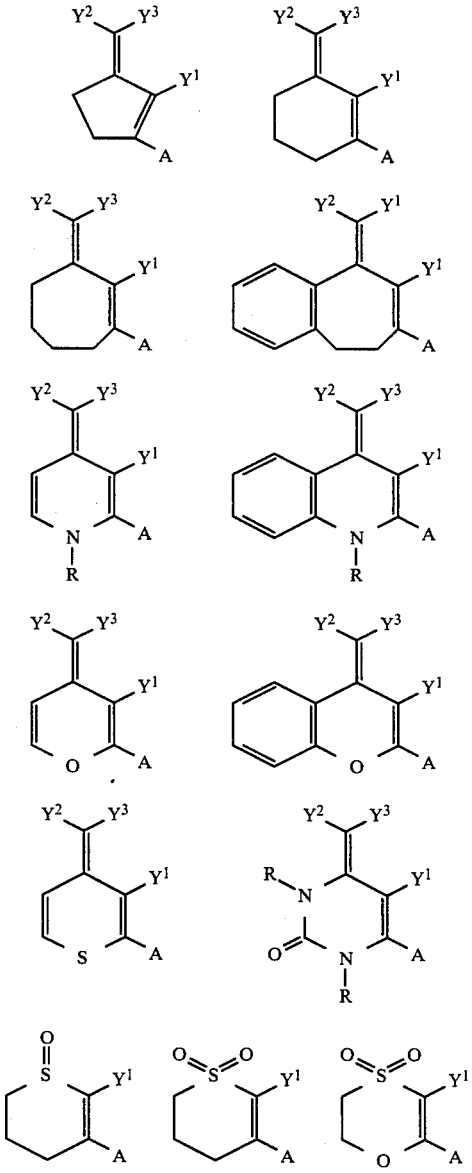

wherein $Y^1$, $Y^2$, $Y^3$ and A are defined as in formulae (I) and (II), and R represents a hydrogen atom, an alkyl group (having, preferably, from 1 to 20 carbon atoms), an aryl group (having, preferably, from 6 to 20 carbon atoms), an acyl group (preferably, HCO— an alkylcarbonyl group having from 2 to 20 carbon atoms, or an arylcarbonyl group having from 7 to 20 carbon atoms), an oxycarbonyl group (preferably, an alkoxycarbonyl group having from 2 to 20 carbon atoms, or an aryloxycarbonyl group having from 7 to 20 carbon atoms), a carbamoyl group (preferably, an alkylcarbamoyl group having from 2 to 20 carbon atoms or an arylcarbamoyl group having from 7 to 20 carbon atoms), a sulfonyl group (preferably, an alkylsulfonyl group having from 1 to 20 carbon atoms or an arylsulfonyl group having from 6 to 20 carbon atoms), a sulfinyl group (preferably, an alkyl-sulfinyl group having from 1 to 20 carbon atoms or an arylsulfinyl group having from 6 to 20 carbon atoms). When the compounds have two or more R, they may be the same or different.

The carbocyclic ring or the heterocyclic ring in the formulae may have one or more substituents in addition to R, $Y^1$ and A and when the ring has two or more substituents, they may be the same or different.

Specific examples of substituents (other than R, $Y^1$ and A) for the above carbocyclic ring or heterocyclic ring include a halogen atom (e.g., fluorine, chlorine, bromine, etc.); an alkyl group (having, preferably, from 1 to 20 carbon atoms); an aryl group (having, preferably, from 6 to 20 carbon atoms); an alkoxy group (having, preferably, from 1 to 20 carbon atoms); an aryloxy group (having, preferably, from 6 to 20 carbon atoms); an alkylthio group (having, preferably, from 1 to 20 carbon atoms); an arylthio group (having, preferably, from 6 to 20 carbon atoms); an acyl group (preferably, HCO— and alkylcarbonyl group having from 2 to 20 carbon atoms or an arylcarbonyl group having from 7 to 20 carbon atoms); an acylamino group (preferably, an alkanoylamino group having from 2 to 20 carbon atoms or an arylcarbonylamino group having 7 to 20 carbon atoms); a nitro group; a cyano group; an oxycarbonyl group (preferably, an alkoxycarbonyl group having from 2 to 20 carbon atoms or an aryloxycarbonyl group having from 7 to 20 carbon atoms); a hydroxy group; a carboxy group; a sulfo group; a ureido group (preferably, an alkylureido group having from 2 to 20 carbon atoms or an aryl ureido group having from 7 to 20 carbon atoms); a sulfonamido group (preferably, an alkylsulfonamido group having from 1 to 20 carbon atoms or an arylsulfonamido group having from 6 to 20 carbon atoms); a sulfamoyl group (preferably, an alkylsulfamoyl group having from 1 to 20 carbon atoms or an arylsulfamoyl group having from 6 to 20 carbon atoms); a carbamoyl group (preferably, an alkylcarbamoyl group having from 2 to 20 carbon atoms or an arylcarbamoyl group having from 7 to 20 carbon atoms); an acyloxy group (preferably, an alkylcarbonyloxy group having from 2 to 20 carbon atoms, an arylcarbonyloxy group having from 7 to 20 carbon atoms and HCOO), an amino group (an unsubstituted amino group or a secondary or tertiary amino group substituted by an alkyl group having from 1 to 20 carbon atoms or an aryl group having from 6 to 20 carbon atoms); a carbonic acid ester group (preferably, an alkyl carbonic acid ester group having from 2 to 20 carbon atoms or an aryl carbonic acid ester group having from 7 to 20 carbon atoms); a sulfonyl group (preferably, an alkylsulfonyl group having from 1 to 20 carbon atoms or an arylsulfonyl group having from 6 to 20 carbon atoms); a sulfinyl group (preferably, an alkylsulfinyl group having from 1 to 20 carbon atoms or an arylsulfinyl group having from 6 to 20 carbon atoms), etc.

Furthermore, the group represented by $Y^1$ is selected according to the pH (usually not less than 8) of the processing solution to provide for processing the photographic material containing the photographic reagent precursor in this invention and to provide for appropriate timing. For example, in the case of processing using a processing solution having a high pH or in the case of requiring slow timing, an electron donative group such as an alkyl group, an alkoxy group, etc., is selected as $Y^1$. On the contrary, in the case of processing the photographic material using a processing solution having a low pH of 9 to 11 or in the case of requiring fast timing, an electron attractive group such as a halogen atom, an acyl group, a sulfonyl group, a cyano group, a nitro group, etc., is selected. Thus, by suitably selecting the group shown by $Y^1$, the releasing rate of the photographic reagent can be controlled over a very wide range.

Specific examples of blocked photographic reagent for use in this invention are illustrated below, but the invention is not limited to these compounds. In the following examples compounds (1)-(22), (29)-(30) and (32) are antifoggants or development restrainer, compounds (23) and (26) are developing agents, compounds (24) and (25) are auxiliary developing agents, compound (31) is a fogging agent, compound (33) is a silver halide solvent, compound (28) is an azo dye, compound (32) is a dye providing compound, and compound (27) is a bleach accelerator.

(1)

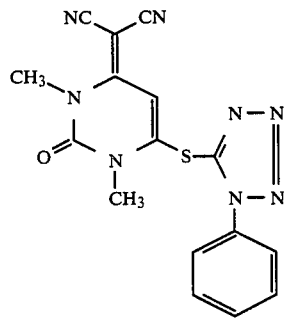

(2)

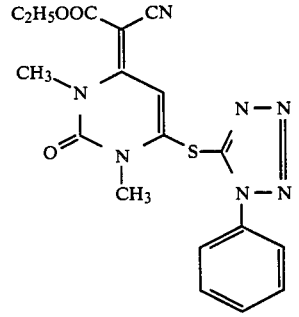

-continued
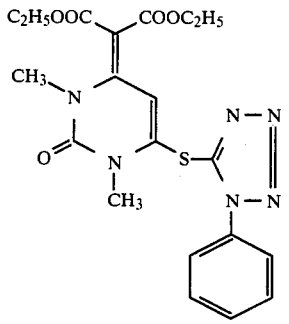
(3)
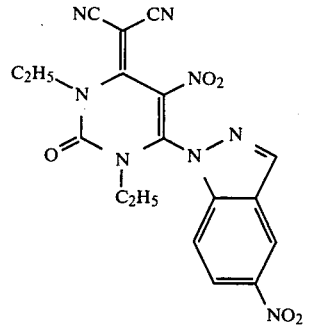
(4)
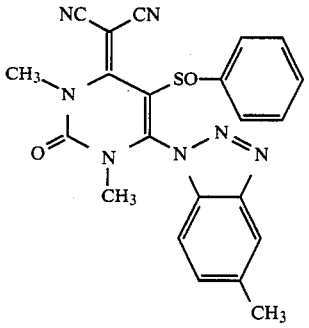
(5)
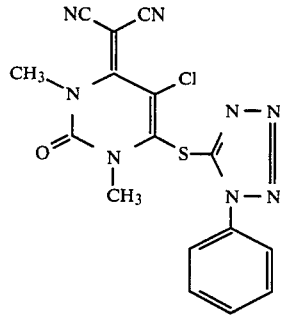
(6)
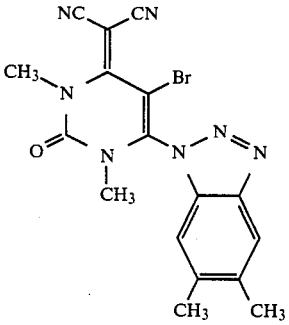
(7)
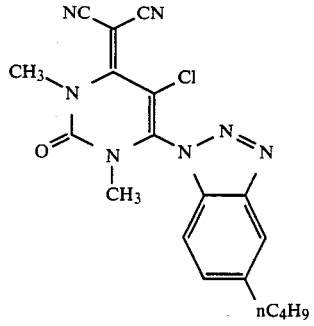
(8)
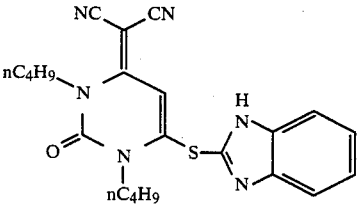
(9)
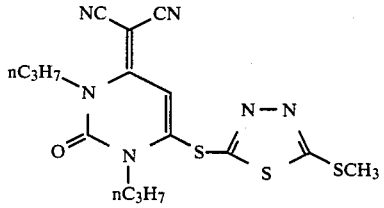
(10)
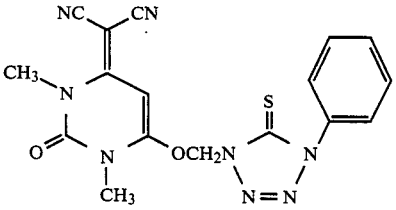
(11)
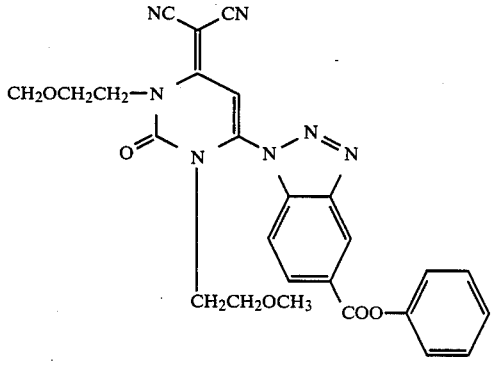
(12)

-continued
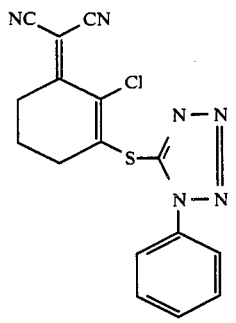
(13)
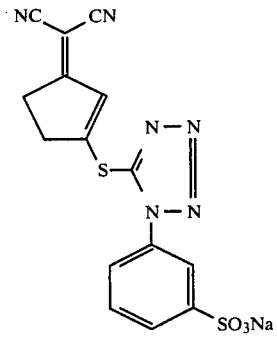
(14)
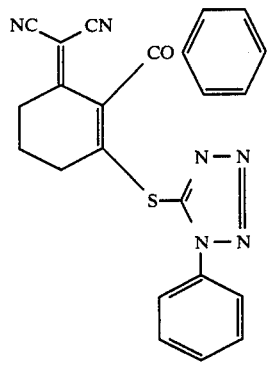
(15)
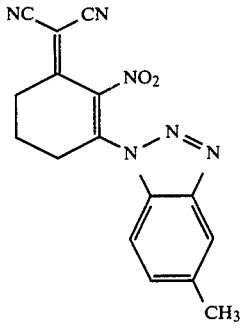
(16)
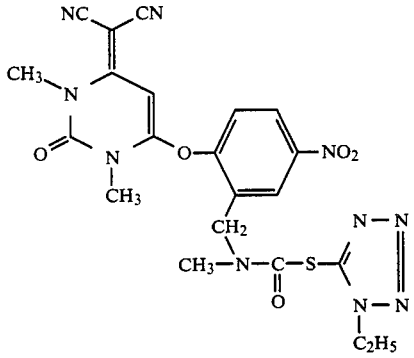
(17)
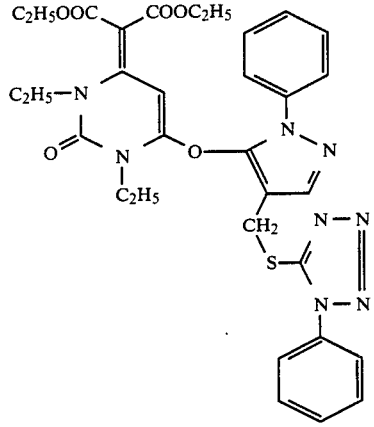
(18)
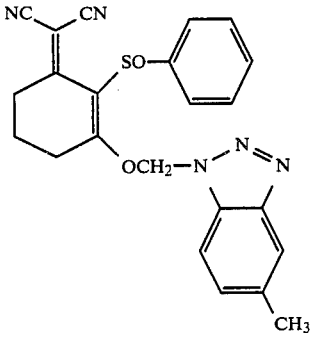
(19)
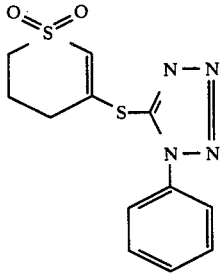
(20)

-continued
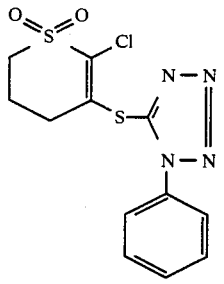
(21)
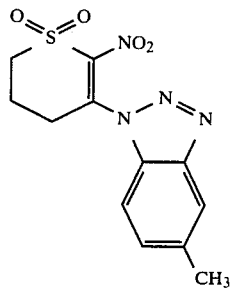
(22)
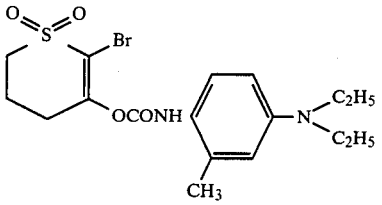
(23)
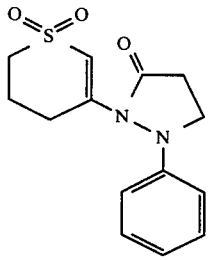
(24)
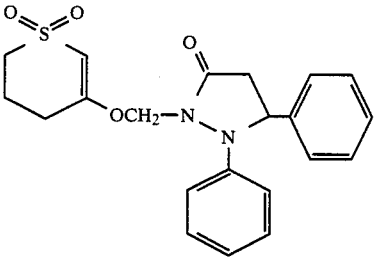
(25)
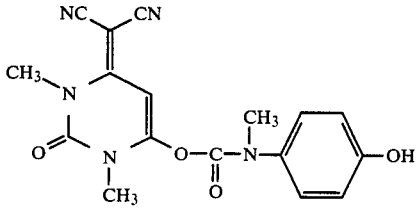
(26)
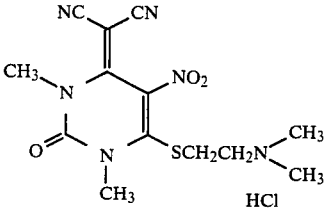
(27)
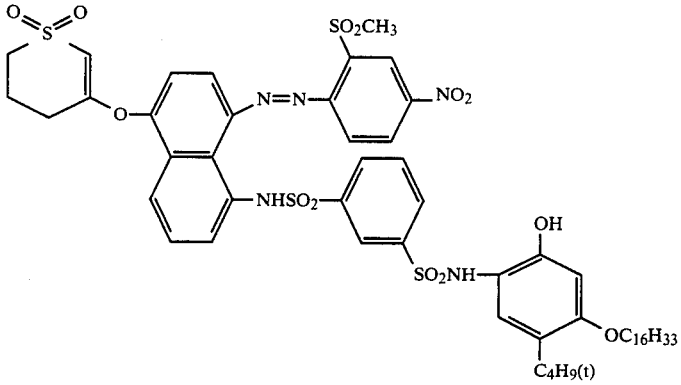
(28)
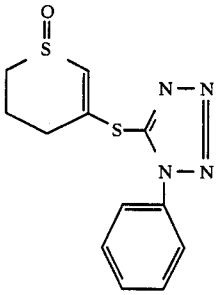
(29)
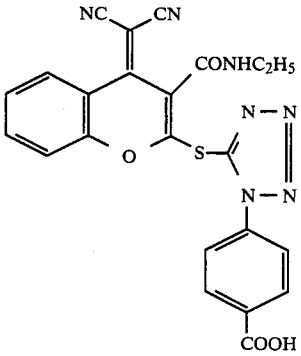
(30)

-continued (31)

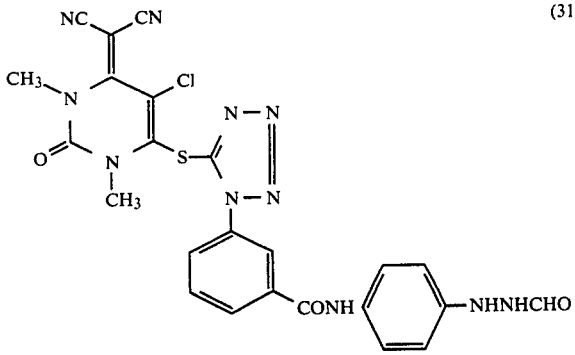

(32)

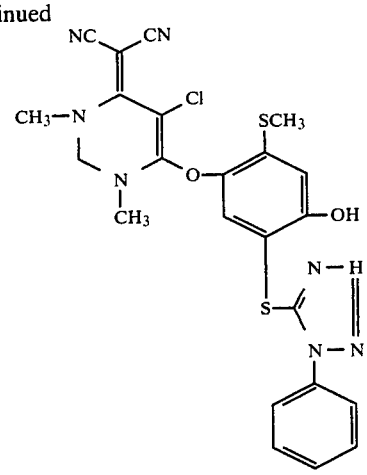

(33)

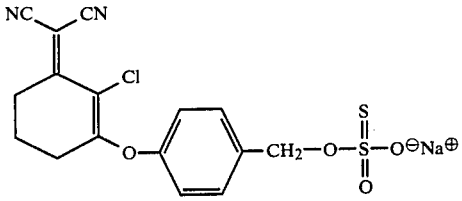

Then, synthesis examples of the specific blocked photographic reagents for use in this invention are shown below.

SYNTHESIS OF COMPOUND (1)

6-Chloro-1,3-dimethyluracil was prepared by the following method described in *Liebigs Ann. Chem.*, Bd. 612, 161 (1958).

That is, 276 g (3.14 moles) of 1,3-dimethylurea and 376 g (3.62 moles) of malonic acid were dissolved in 600 ml of glacial acetic acid at 60° to 70° C., and then, after adding thereto 1250 ml of acetic anhydride, the temperature of the mixture was gradually increased to 90° C. Then, after stirring the mixture for 6 hours at the same temperature, the reaction mixture was allowed to stand overnight at room temperature and glacial acetic acid and acetic anhydride were distilled off under reduced pressure. The residue thus formed was added to 500 ml of ethanol while still hot and the crystals thus precipitated were collected by filtration, heat-refluxed for 2 hours with 380 ml of concentrated hydrochloric acid and 400 ml of water, and then allowed to stand for 6 hours under ice-cooling. The crystals thus precipitated were collected by filtration and washed with a small amount of ethanol to provide 360 g of 1,3-dimethylbarbituric acid.

To 110 g of 1,3-dimethylbarbituric acid thus obtained was added 32 ml of water, and then 800 ml of phosphorus oxychloride was gradually added dropwise to the mixture. After heat-refluxing the mixture for 1.5 hours, the phosphorus oxychloride was distilled off under normal atmospheric pressure, the residue formed was poured onto ice while still hot, and the crystals thus precipitated were collected by filtration. The filtrate was extracted thrice with chloroform, and the extract was dried by anhydrous sodium sulfate. Then, the chloroform was distilled off, the residue thus obtained was mixed with the crystals collected in the aforesaid step and the mixture was recrystallized from water to provide 80 g of 6-chloro-1,3-dimethyluracil.

Then, to a solution comprising of 100 ml of a tetrahydrofuran and 6.6 g (0.1 mole) of malononitrile was added 4.0 g (0.1 mole) of 60 wt% sodium hydride in nujol (paraffin oil) under ice-cooling, and, after adding thereto 17 g (0.1 mole) of 6-chloro-1,3-dimethyluracil, the mixture was stirred for 5 hours at room temperature. The reaction mixture thus obtained was mixed with 100 ml of water, neutralized with concentrated hydrochloric acid, and thereafter extracted with 200 ml of ethyl acetate. The extract was dried by anhydrous sodium sulfate, the solvent was distilled off under reduced pressure, and the crystals thus precipitated were collected by filtration to provide 12.9 g (63%) of 6-dicyanomethyl-1,3-dimethyluracil.

To 6.1 g (0.03 mole) of 6-dicyanomethyl-1,3-dimethyluracil thus obtained was added 1.5 ml of water and then 40 ml of phosphorus oxychloride was gradually added dropwise to the mixture. After heat-refluxing the resultant mixture for 1.5 hours, phosphorus oxychloride was distilled off under normal atmospheric pressure, and the residue thus formed was poured onto ice. The crystals thus precipitated were collected by filtration. The filtrate was extracted thrice with chloroform and dried by anhydrous sodium sulfate. Then, the chloroform was distilled off, the residue thus formed was mixed with the crystals collected in the aforesaid step, and the mixture was recrystallized from a mixture of water and methanol to provide 6.15 g of 6-chloro-1,3-dimethyl-2-oxo-4-dicyanomethylenepyrimidine.

Then, to a solution comprising of 20 ml of a methanol and 1.78 g (0.01 mole) of 5-mercapto-1-phenyltetrazole was added 1.93 g (0.01 mole) of methanol solution of 28% sodium methylate, and after stirring the mixture for 5 minutes at room temperature, methanol was distilled off under reduced pressure. The residue thus formed was dissolved in 30 ml of tetrahydrofuran, and, after adding thereto 2.2 g (0.01 mole) of 6-chloro-1,3-dimethyl-2-oxo-4-dicyanomethylenepyrimidine thus prepared in the above step, the mixture was heat-refluxed for 2 hours. The reaction mixture thus formed was poured into ice water and the crystals thus precipitated were collected by filtration and then recrystallized from methanol to provide 3.2 g (89%) of compound (1).

SYNTHESIS OF COMPOUND (7)

To a solution comprising of 40 ml of a tetrahydrofuran and 1.5 g (0.01 mole) of 5,6-dimethylbenzotriazole was added a solution comprising of 10 ml of tetrahydrofuran and 1.67 g (0.01 mole) of DBU (1,5-diazabicyclo[5,4,0]undecene-5) at room temperature, and then after adding thereto 2.2 g (0.01 mole) of 6-chloro-1,3-dimethyl-2-oxo-4-dicyanomethylenepyrimidine described above in the synthesis of Compound (1), the mixture was heat-refluxed for 11 hours. The reaction mixture thus formed was poured into ice water and the crystals thus precipitated were collected by filtration to provide 2.9 g (87%) of Compound (7).

SYNTHESIS OF COMPOUND (20)

After adding dropwise 38.1 g (0.3 mole) of oxalyl chloride to a solution comprising of 100 ml of a methylene chloride and 14.8 g (0.1 mole) of thian-3-one-1,1-dioxide (prepared by the method described in *Chem. Ber.*, Vol. 114, 909 (1981) under ice-cooling, the mixture was stirred for 2 days at room temperature. The reaction mixture was concentrated under reduced pressure to provide 16.0 g of 5-chloro-2,3-dihydro-4H-thiine with a yield of 96%.

To a solution comprising of 10 ml of a tetrahydrofuran and 1.78 g (0.01 mole) of 5-mercapto-1-phenyltetrazole, 5 ml of glacial acid, and 1.68 g (0.02 mole) of sodium acetate was added 1.67 g (0.01 mole) 5-chloro-2,3-dihydro-4H-thiine with stirring, and the mixture was stirred for 5 hours at 60° to 70° C. The reaction mixture was poured onto ice water, extracted with ethyl acetate, and the organic layer was collected; dried by anhydrous sodium sulfate, and concentrated. The residue thus formed was purified by silica gel column chromatography (using a mixture of ethyl acetate and hexane as the eluent) to provide 1.94 g of Compound (20) as a colorless oily product. The yield for the product was 63%.

The photographic reagent precursor in this invention may be used individually or as a combination of them.

The blocked photograhic reagent (precursor) in this invention may be incorporated in any desired layer of a silver halide photographic material, such as a silver halide emulsion layer, a dye providing compound containing layer, a subbing layer, a protective layer, an interlayer, a filter layer, an antihalation layer, an image-receiving layer, a coversheet layer, etc., which are provided on a support.

For incorporating the precursor for use in this invention, the precursor is added to the coating solution for forming the layer as is, or as a solution thereof in a solvent having no adverse effects on the photographic properties of the photographic material, such as water, an alcohol, etc., at a proper concentration. Also, the precursor may be dissolved in a high-boiling organic solvent or a low-boiling organic solvent and dispersed in an aqueous solution. Also, the precursor may be added to the coating solution as a polymer latex impregnated with the precursor by the method described in Japanese Patent Application (OPI) Nos. 39,853/76; 59,942/76; 32,552/79; U.S. Pat. No. 4,199,363, etc.

The precursor for use in this invention may be added to the coating solution at any time in the production steps for photographic materials, but, in general, it is preferred to add the precursor directly before coating the coating solution.

The preferred addition amount of the photographic reagent precursor for use in this invention differs according to the kind of the photographically useful reagent, and is generally from $10^{-8}$ to $10^{-1}$ mole per mole of silver for an antifoggant or a development restrainer (preferably from $10^{-6}$ to $10^{-1}$ mole for a mercapto-based antifoggant and $10^{-5}$ to $10^{-1}$ for an azole-base antifoggant (e.g., benzotriazole); from $10^{-2}$ to 10 moles, and preferably from 0.1 to 5 moles, per mole of silver for a developing agent; from $10^{-4}$ to 10 moles, and preferably from $10^{-2}$ to 5 moles per mole of silver for a pyrazolidone-series auxiliary developing agent; from $10^{-2}$ to $10^{-6}$ mole, and preferably from $10^{-3}$ to $10^{-5}$ mole, per mole of silver for a fogging agent; from $10^{-3}$ to 10 moles, and preferably from $10^{-2}$ to 1 mole per mole of silver for a silver halide solvent such as hypo, etc.; from $10^{-5}$ to 0.1 mole, and preferably from $10^{-4}$ to $10^{-2}$ mole, per mole of silver for a bleach accelerator; and from $10^{-3}$ to 1 mole, and preferably from $5\times10^{-3}$ to 0.5 mole, per mole of silver for a dye or a dye-providing compound for color diffusion transfer photographic material.

Since the photographic reagent precursor for use in this invention has a blocking group as shown in the above-described general formulae, the precursor is completely stable during the storage of the photographic material containing it, and can release the photographic reagent at the appropriate time during processing. Furthermore, according to the present invention, there is an advantage in that by properly selecting the substituent $Y^1$ of formula (I) or (II) described above, a photographic reagent precursor capable of exhibiting the function thereof over a wider pH range can be easily obtained.

The photographic material of this invention using the photographic reagent precursor the photographic reagent moiety which is an antifoggant or a development restrainer shows the feature that the screen range in the case of forming dot images is long, and hence is very suitable as a photographic material for making a printing plate.

Also, the precursor for use in this invention can be used for color photographic materials in coupler system.

The precursor for use in this invention can also be used for the system by silver dye bleaching process as described, for example, in T. H. James, *The Theory of the Photographic Process*, Chapter 12, "Principles and Chemistry of Color Photography", IV, Silver Dye Bleach Process, 4th Edition, pages 363–366, published by Macmillan, New York, 1977.

Moreover, the precursors for use in this invention can be used for black-and-white photographic materials such as medical X-ray photographic films, black-and-white photographic films for general photography, lithographic light-sensitive films, scanner films, etc.

When the precursor for use in this invention is applied for a color diffusion transfer photographic process, the photographic material may have the construction of a peel apart type film unit, an integrated type film unit as described in Japanese Patent Publication No. 16,356/71; 33,697/73; Japanese Patent Application (OPI) No. 13,040/75; U.K. Pat. No. 1,330,524, etc.; or a separation unnecessary type film unit as described in Japanese Patent Application (OPI) No. 119,345/82.

A precursor as shown by formula (I) or (II) for use in this invention may be incorporated in any layer or layers of a silver halide photographic material of this invention if it is so associated that it effectively functions for at least one of development processings of the silver halide emulsion layers of the photographic material and is preferably incorporated in light-sensitive layer such as silver halide emulsion layers, dye image-providing compound-containing layers, auxiliary layers, etc.; auxiliary layers such as image-receiving layers, white reflecting layers, etc.; neutralizing systems such as neutralizing layers and neutralization timing layers. It is particularly preferred that the precursor be incorporated in a neutralizing layer or a neutralization timing layer.

For introducing the precursor for use in this invention and couplers which can be used together with the precursor in silver halide emulsion layers, the method described in U.S. Pat. No. 2,322,027, etc., can be utilized. For example, the compound or compounds are dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, diethyl azelate, etc.), a trimesic acid ester (e.g., tributyl trimesate, etc.), etc., or a low-boiling organic solvent having a boiling point of about 30° C. to 150° C., such as a lower alkyl actate (e.g., ethyl acetate, butyl acetate, etc.), ethyl propionate, secondary butyl alcohol, methyl isobutyl ketone, β-ethoxyethyl acetate, methylcellosolve acetate, etc., and then dispersed in an aqueous solution of a hydrophilic colloid. A mixture of the aforesaid high-boiling organic solvent and low-boiling organic solvent can be used.

Also, the dispersing method using the polymer described in Japanese Patent Publication No. 39,853/76 and Japanese Patent Application (OPI) No. 59,943/76 can be used.

When the coupler has an acid group such as a carboxylic acid group or a sulfonic acid group, the compound is introduced into an aqueous solution of a hydrophilic colloid as an alkaline aqueous solution thereof.

As the binder or protective colloid for the emulsion layers and interlayers of the photographic materials of this invention, gelatin is advantageously used, but other hydrophilic colloid may also be used, either alone or with gelatin. Gelatin for use in this invention may be limed gelatin or acid-treated gelatin. Details for the preparation of gelatin are described, e.g., in Arther Veis, *The Macromolecular Chemistry of Gelatin* (published by Academic Press, 1964).

The silver halide photographic emulsions for use in this invention may furthermore contain surface active agents, individually or as a mixture thereof.

They are generally used as a coating aid, but are sometimes used for other purposes, such as for the improvement of dispersibility or improvement of sensitized photographic characteristics, the prevention of static problems, the prevention of sticking of the photographic materials, etc. These surface active agents include natural surface active agents such as saponin, etc.; nonionic surface active agents such as alkylene oxide series surface active agents, glycerol series surface active agents, glycidol series surface active agents, etc.; cationic surface active agents such as higher alkyl amines, quaternary ammonium salts, heterocyclic ring compounds (e.g., pyridine, etc.), phosphoniums, sulfoniums, etc.; anionic surface active agents containing an acid group such as carboxylic acid, sulfonic acid, phosphoric acid, sulfuric acid ester group, phosphoric acid ester group, etc.; amphoteric surface active agents such as amino acids, aminosulfonic acid, sulfuric or phosphoric acid esters of amino alcohol, etc.

Examples of the surface active agents which can be used in this invention are described, for example, in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974; German Patent Application No. 1,942,665; U.K. Pat. Nos. 1,077,317, 1,198,450, etc. as well as in Ryohei Oda, *Synthesis of Surface Active Agents and Application Thereof*, published by Maki Shoten, 1964; A. W. Perry, *Surface Active Agents*, published by Interscience Publication Incorporated, 1958; J. P. Sisley, *Encyclopedia of Surface Active Agents*, published by Chemical Publish Company, 1964, etc.

As the polyalkylene oxide compound for use in this invention, there are, for example, a condensation product of a polyalkylene oxide composed, preferably, of at least 10 units of an alkylene oxide having from 2 to 4 carbon atoms such as ethylene oxide, propylene-1,2-oxide, butylene-1,2-oxide, etc., and a compound having at least one active hydrogen atom, such as water, an aliphatic alcohol, an aromatic alcohol, a fatty acid, an organic amine, a hexitol derivative, etc., and a block copolymer of two or more polyalkylene oxides.

Specific examples of the polyalkylene oxide compounds are polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycolamines,
polyalkylene glycol block copolymers,
polyalkylene glycol graft polymers, etc.

It is necessary that the molecular weight of the polyalkylene oxide compound is higher than 600.

The polyalkylene oxide chain contained in the molecule may be one or more than two. In this case, the polyalkylene oxide compound may be composed of an alkylene oxide unit having less than 10 polyalkylene oxide chains, but the sum of the alkylene oxide units in the molecule must be at least 10. When the molecule has two or more polyalkylene oxide chains, each of the polyalkylene oxide chains may be composed of a different alkylene oxide unit, for example, one is composed of ethylene oxide and the other is composed of propylene oxide. The polyalkylene oxide compound for use in this invention contains, preferably, from 14 to 100 alkylene oxide units.

Practical examples of polyalkylene oxide compounds which can be used together with the precursor in this invention are as follows.

$HO(CH_2CH_2O)_{90}H$ P-1

$C_4H_9O(CH_2CH_2O)_{15}H$ P-2

$C_{12}H_{25}O(CH_2CH_2O)_{15}H$ P-3

-continued $C_{18}H_{37}O(CH_2CH_2O)_{15}H$ P-4

$C_{18}H_{37}O(CH_2CH_2O)_{40}H$ P-5

$C_8H_{17}CH{=}CHC_8H_{16}O(CH_2CH_2O)_{15}H$ P-6

P-7

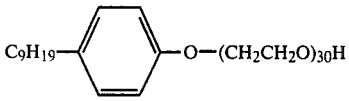

P-8

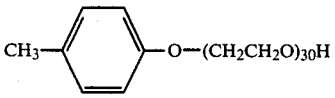

P-9

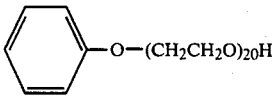

$C_{11}H_{23}COO(CH_2CH_2O)_{80}H$ P-10

$C_{11}H_{23}COO(CH_2CH_2O)_{24}OCC_{11}H_{23}$ P-11

$C_8H_7CH(COO(CH_2CH_2O)_9H)_2$ P-12

$C_{11}H_{23}CONH(CH_2CH_2O)_{15}H$ P-13

$C_{12}H_{25}N(CH_2CH_2O)_{15}H)_2$ P-14

$C_{14}H_{29}N(CH_2)(CH_2CH_2O)_{24}H$ P-15

$H(OCH_2CH_2)_{14}O{-}CH(CH_2OC_{11}H_{23}){-}CH(O(CH_2CH_2O)_{14}H){-}CH{-}(CH_2CH_2O)_{14}H$ P-16

$H(CH_2CH_2O)_a(CH(CH_3)CH_2O)_b(CH_2CH_2O)_cH$ P-17 a + b + c = 50 b:a + c = 10:9

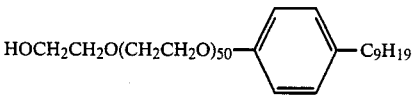

P-18

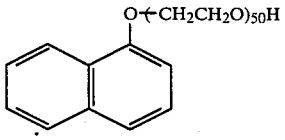

P-19

$HO(CH_2CH_2O)_a(CH_2CH_2CH_2CH_2O)_b(CH_2CH_2O)_cH$ P-20 a + c = 30, b = 14

$HO(CH_2CH_2O)_a(CH(C_6H_5)CH_2O)_b(CH_2CH_2O)_cH$ P-21 b = 8, a + c = 50

P-22

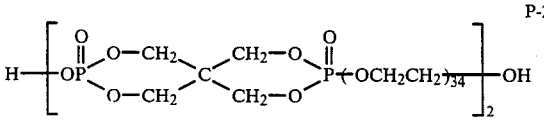

-continued

P-23

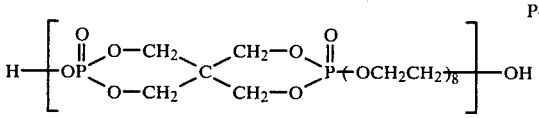

$HO(CH_2CH_2O)_{34}H$ P-24

The above-illustrated polyalkylene oxide compounds are described in Japanese Patent Application (OPI) Nos. 156,423/75, 108,130/77 and 3,217/78. These polyalkylene oxide compounds may be used individually or as a combination thereof.

In the case of adding the polyalkylene oxide compound to a silver halide emulsion, the compound can be added to a silver halide emulsion as an aqueous solution thereof at a proper concentration or a solution thereof in a low-boiling organic solvent which can be miscible with water at any desired time before coating, preferably after chemical ripening of the silver halide emulsion. It is preferred that the polyalkylene oxide compound is used in an amount of $1\times10^{-5}$ mole to $1\times10^{-2}$ mole.

For the photographic emulsion layers of the photographic materials of this invention, silver bromide, silver iodobromide, silver iodochloro-bromide, silver chlorobromide, or silver chloride can be used as the silver halide. Preferred silver halide is silver iodobromide containing less than 15% silver iodide. A particularly preferred silver halide is silver iodobromide containing from 2 mole% to 12 mole% silver iodide.

There is no particular restriction with respect to the mean grain size (expressed by the diameter of grain when the grain is a spherical grain or a grain similar to spherical grain or expressed by the side length based on the projection area when the grain is a cubic grain), but it is preferred that the mean grain size is less than 3 $\mu$m.

The grain size distribution of the silver halide grains for use in this invention may be narrow or broad.

The silver halide grains in the silver halide photographic emulsions for use in this invention may have a regular crystal form such as a cube or an octahedron, or may be an irregular crystal form such as a spherical form or a tabular form, or may be a composite form of these crystal forms. Also, the silver halide grains may be composed of a mixture of various crystal forms.

Furthermore, a silver halide emulsion wherein more than 50% of the total projection areas are occupied by the silver halide grains of a super tabular form having a diameter thereof more than five times longer than the thickness may be used in this invention.

The silver halide grain may have different phase between the inside thereof and the surface layer thereof. Also, the silver halide grains may be of the type that a latent image is mainly formed on the surface thereof, of of the type that a latent image is mainly formed in the inside thereof.

The silver halide photographic emulsions for use in this invention can be prepared using the methods described, for example, in P. Glafkides, *Chimie et Physique Photographique,* (published by Paul Montel Co., 1967); G. F. Duffin, *Photographic Emulsion Chemistry,* (published by the Focal Press, 1966); V. L. Zelikman et al., *Making and Coating Photographic Emulsion.* (published by The Focal Press, 1964), etc.

That is, an acid method, a neutralization method, an ammonia method, etc., can be used, and also, as a manner of reacting a soluble silver salt and a soluble halide, a one side mixing method, a simultaneous mixing method, or a combination of these methods can be utilized.

Also, the silver halide emulsion can be prepared by using a so-called back mixing method, i.e., the method of forming the silver halide grains in the presence of an excessive amount of silver ion.

As one system of the simultaneous mixing method, a method of maintaining a constant pAg in a liquid phase for forming silver halide, that is, a so-called controlled double jet method can be used. According to this method, a silver halide emulsion having a regular crystal form and almost uniform grain sizes can be obtained.

Two or more kinds of silver halide emulsions formed separately may be used as a mixture.

The silver halide grains may be formed or physically ripened in the presence of a cadmium salt, a zinc salt, a lead salt, a thallium salt, an iridium salt or a complex salt thereof, a rhodium salt or a complex salt thereof, or an iron salt or complex salt thereof.

Silver halide emulsions for use in this invention are usually chemically sensitized. For the chemical sensitization, the method described, for example, in H. Frieser edited, *Die Grundlagen der Photographischen Prozesse mit Silverhalogeniden,* (Akademische Verlagsgesellschaft, 1968), 675 to 734 pages can be used.

More particularly, there is a sulfur sensitizing method using a sulfur-containing compound capable of reacting with active gelatin or silver (e.g., a thiosulfate, a thiourea, a mercapto compound, a thodanine, etc.); a reduction sensitizing method using a reducing material (eg., a stannous salt, an amine, a hydrazine derivative, formamidinesulfinic acid, a silane compound, etc.); and a noble metal sensitizing method using a noble metal compound (e.g., a gold complex salt and complex salts of metals belonging to group VIII of the periodic table, such as Pt, Ir, Pd, etc.). These methods may be used individually or as a combination thereof.

The silver halide photographic emulsions for use in this invention may further contain various compounds for preventing the formation of fog during the storage and processing of the photographic materials of this invention and for stabilizing the photographic performance of the photographic materials. For examples, there are many compounds known as antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines, mercaptotriazines; thioketo compounds (e.g., oxazolinethione); azaindenes (e.g., triazaindenes, tetraazaindenes (in particular, 4-hydroxysubstituted(1,3-,3a,7)tetraazaindenes), pentaazaindenes, etc.); benzenethiosulfonic acid, benzenesulfinic acid, benzenesulfonic acid amide, etc.

The silver halide photographic emulsion layers of the photographic materials of this invention may further contain thioether compounds, thiomorpholines, quaternary ammonium compounds, urethane derivatives, urea derivatives, imidazole derivatives, 3-pyrazolidones, etc., for increasing the sensitivity of the photographic materials, increasing the contrast thereof, or accelerating development.

Moreover, the photographic materials of this invention can also contain a dispersion of a water-insoluble or water sparingly soluble synthetic polymer in the silver halide photographic layers and other hydrophilic colloid layers for improving the dimensional stability thereof. As such a synthetic polymer, there are polymers and copolymers of an alkyl (meth)acrylate, an alkoxyalkyl (meth)acrylate, glycidyl (meth)acrylate, (meth)acrylamide, a vinyl ester (e.g., vinyl acetate), acrylonitrile, olefin, styrene, etc., singly or as a combination thereof, or further combination of the above monomer and acrylic acid, methacrylic acid, $\alpha$, $\beta$-unsaturated dicarboxylic acid, hydroxyalkyl (meth)acrylate, sulfoalkyl (meth)acrylate, styrenesulfonic acid, etc.

The silver halide photographic emulsions for use in this invention may be spectrally sensitized by methine dyes, etc. Examples of such dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. For these days, any nuclei which are usually utilized for cyanine dyes can be applied as basic heterocyclic nuclei. Such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc., nuclei formed by diffusing aliphatic hydrocarbon rings to these nuclei; nuclei formed by diffusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on a carbon atom.

Merocyanine dyes or complex merocyanine dyes can include 5-membered or 6-membered heterocyclic nuclei such as pyrazoline-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above-described sensitizing dyes may be used individually or as a combination thereof. The combination of sensitizing dyes is frequently used for the purpose of supersensitization.

The photographic emulsions for use in this invention may further contain a dye having no spectral sensitizing action by itself or a material which does not substantially absorb visible light, but shows supersensitization together with the sensitizing dye. As such compounds, there are, for example, the aminostryl compounds substituted by a nitrogen-containing heterocyclic ring group (as described, for example, in U.S. Pat. Nos. 2,933,390 and 3,635,721), the aromatic organic acid-formaldehyde condensation products (described, for example, in U.S. Pat. No. 3,743,510); cadmium salts; azaindene compounds, etc.

This invention can be applied to a multilayer multicolor photographic material having at least two silver halide photographic emulsion layers of different spectral sensitivity on a support. A multilayer natural color photographic material usually has at least one red-sensitive emulsion layer, at least one green-sensitive emulsion layer, and at least one blue-sensitive emulsion layer on a support. The order of these emulsion layers can be desirably selected. Usually the red-sensitive emulsion layer contains a cyan-forming coupler, the green-sensitive emulsion layer contains a magenta-forming coupler, and the blue-sensitive emulsion layer contains a yellow-forming coupler, but other combination may be employed if desired.

The photographic materials of this invention may further contain in the silver halide photographic emulsion layers or non-sensitive layers dye-forming couplers, that is, the compounds capable of coloring by the oxidative coupling reaction with an aromatic primary amino developing agent (e.g., a phenylenediamine derivative and an aminophenol derivative) in the color development. Examples of such dye-forming couplers are magenta dye-forming couplers (magenta couplers) such as 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetylcumarone couplers, open chain acylacetonitrile couplers, etc.; yellow couplers such as acylacetamide couplers (e.g., benzolacetanilides, pivaloylacetanilides, etc.), etc.; and cyan couplers such as naphthol couplers and phenol couplers. The above-described couplers may be incorporated in the same silver halide photographic layer or nonsensitive layer wherein the precursor of the present invention is included. It is preferred that these couplers have a hydrophobic group referred to as "a ballast group" in the molecule, or are polymerized.

The couplers may be four equivalent or two equivalent with respect to silver ion. Also, colored couplers having a color correction effect or so-called DIR couplers, i.e., the couplers capable of releasing a development inhibitor with the progress of development, can be used.

Other than the DIR couplers the photographic materials of this invention may contain non-coloring DIR coupling compounds which form a colorless coupling reaction product and release a development inhibitor. Also, the photographic material of this invention may contain a compound releasing a development inhibitor with the progress of development in place of the DIR coupler.

The blocked couplers according to this invention and the above-described couplers may be incorporated in one photographic layer as more than two kinds thereof for meeting the characteristics required for photographic material, or the same compounds may be incorporated in two or more layers.

The photographic materials of this invention may further contain an inorganic or organic hardening agent in the silver halide photographic emulsion layers or other hydrophilic colloid layers. Examples of the hardening agent are chromium salts (e.g., chromium alum, chromium acetate, etc.), aldehydes (e.g., formaldehyde, glyoxal, glutar aldehyde, etc.), N-methylol compounds (e.g., dimethylolurea, methyloldimethylhydantoin, etc.) dioxane derivatives (e.g., 2,3-dihydroxyioxane, etc.), active vinyl compounds (1,3,5-triacryloyl-hexahydro-s-triazine, 1,3-vinylsulfonyl-2-propanol, etc.) active halogen compounds (2,4-dichloro-6-hydroxy-s-triazine, etc.), mucohalogenic acids (e.g., mucochloric acid, mucophenoxychloric acid, etc.), etc. They can be used individually or as a combination thereof.

When the photographic materials of this invention contains dyes or ultraviolet absorbents in the hydrophilic colloid layers, they may be mordanted by a cationic polymer.

The photographic materials of this invention may contain hydroquinone derivatives, aminophenol derivatives, gallic acid derivatives, ascorbic acid derivatives, etc., as color fogging preventing agents.

The photographic materials of this invention may contain ultraviolet absorbents in the hydrophilic colloid layers. Examples of the ultraviolet absorbents are benzotriazole compounds substituted by an aryl group (described for example, in U.S. Pat. No. 3,533,794), 4-thiazolidone compounds (described, for example, in U.S. Pat. Nos. 3,314,794 and 3,352,681), benzophenone compounds (described, for example, in Japanese Patent Application (OPI) No. 2784/71, cinnamic acid ester compounds (described, for example, in U.S. Pat. No. 3,705,805 and 3,707,375), butadiene compounds (described, for example, in U.S. Pat. No. 4,045,229), and benzoxydol compounds (described, for example, in U.S. Pat. No. 3,700,455). Ultraviolet absorptive couplers (e.g., α-naphtholic cyan dye-forming couplers) or ultraviolet absorptive polymers may be used as the ultraviolet absorbents. These ultraviolet absorbents may be mordanted to specific layers of the photographic materials.

The photographic materials of this invention may further contain in the hydrophilic colloid layers water-soluble dyes as filter dyes or for various other purposes, such as irradiation preventing agents. Examples of such dyes are oxonol dyes, hemioxonol dyes, styryl dyes, merocyanine dyes, cyanine dyes, and azo dyes. Of these dyes, oxonol dyes, hemioxonol dyes, and merocyanine dyes are particularly advantageous.

The photographic materials of this invention may also contain fading preventing agents or dye image stabilizers and they can be used solely or as a mixture of them. Examples of such agents are hydroquinone derivatives, gallic acid derivatives, p-alkoxyphenols, p-oxyphenol derivatives, and bisphenols.

There is no particular restriction on the development process for the silver halide photographic materials of this invention and known development process and processing solutions described, for example, in *Research Disclosure,* Vol. 176, pages 28–30 can be applied for processing the photographic materials.

The photographic process may be a black-and-white photographic process, i.e., for forming silver images, or a color photographic process for forming dye images. The processing temperature is usually selected between 18° C. and 50° C., but it may be lower than 18° C. or higher than 50° C.

The silver halide photographic material of the present invention may be that which is subjected to a thermo development treatment.

For foming dye images using the photographic materials of this invention, conventional methods, for example, a negative-positive method may be used as described, for example, in *Journal of the Society of Motion Picture and Television Engineers,,* Vol. 61, 667–701 (1953); a color reversal process of obtaining dye positive images by developing the photographic material with a developer containing a black and white developing agent to form silver images, performing at least one uniform light exposure or other proper fogging treatment, and then performing color development; or a silver dye bleaching process of developing the photographic emulsion layers containing dyes after light exposure to form silver images and then bleaching the dyes using the silver images as the bleaching catalyst.

The color developer which is used for developing the photographic materials of this invention is generally composed of an alkaline aqueous solution containing a color developing agent. Examples of the color developing agent are conventional primary aromatic amino developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.).

Furthermore, the color developing agents described in L. F. A. Mason, *Photographic Processing Chemistry (published by The Focal Press,* 1966), pages 226–229; U.S. Pat. Nos. 2,193,015 and 2,592,364; and Japanese Patent Application (OPI) No. 64,933/73 can be used.

The color developer may further contain a pH buffer such as a sulfite, carbonate, borate or phosphate of an alkali metal and a development restrainer or an antifoggant such as a bromide, an iodide, and an organic antifoggant. Also, if necessary, the color developers may further contain water softeners, preservatives such as hydroxylamine, etc., organic solvents such as benzyl alcohol, diethylene glycol, etc., development accelerators such as polyethylene glycol, a quaternary ammonium salt, amines, etc., dye-forming couplers, competing couplers, fogging agents such as sodium boron hydride, etc., auxiliary developing agents such as 1-phenyl-3-pyrazolidone, etc., tackifiers, polycarboxylic acid-base chelating agents, antioxidants, etc.

After color development, the photographic materials are usually bleached. The bleach process may be performed individually or together with fix process. As the bleaching agent, compounds of multi-valent metals such as iron (III), cobalt (III), chromium (VI), copper (II), etc., peracids, quinones, nitroso compounds, etc., can be used.

Examples of the bleaching agent are ferricyanides, dichromates, organic complex salts of iron (III) or cobalt (III), aminopolycarboxylic acids such as ethylenediaminetetraacetic acid, nitrilotriacetic acid, 1,3-diamino-2-propanoltetraacetic acid, etc., complex salts of organic acids such as citric acid, tartaric acid, malic acid, etc., persulfates, permagnates, nitrosophenol, etc. In these materials, potassium ferricyanide, ethylenediaminetetraacetic acid iron (III) sodium and ethylenediaminetetraacetic acid iron (III) ammonium are particularly useful. Ethylenediaminetetraacetic acid iron (III) complex salts can be effectively used for a bleach solution or a blix solution.

A fix solution having a conventional composition can be used. As the fixing agent, thiosulfates, thiocyanates, and organic sulfur compounds having an effect as a fixing agent can be used. The fix solution may contain a water-soluble aluminum salt as a hardening agent.

The developer for use in the case of black-and-white development contains a known developing agent such as dihydroxybenzenes (e.g., hydroquinone), 3-pyrazolidones (e.g., 1-phenyl-3-pyrazolidone), aminophenols (e.g., N-methyl-p-aminophenol), etc. They can be used individually or as a combination thereof. The black-and-white developers may further contain preservatives, alkali agents, pH buffers, antifoggants, etc. If necessary, the developers may further contain dissolution aids, color toning agents, development accelerators, surface active agents, defoaming agents, water softeners, hardening agents, tackifiers, etc.

The photographic materials of this invention can be subjected to a so-called "lithographic type" development process. The expression "lithographic type development process" refers to a development process for infectiously performing the development step using usually a dihydroxybenzene as the developing agent under a low sulfide ion concentration for the photographic regeneration of line images or for the photographic regeneration of half tone images by dots. This development process is described in detail, for example, in Mason, *Photographic Processing Chemistry* pages 163–165 (1966).

The invention is explained in more detail by the following examples, but the invention is not limited to these examples.

EXAMPLE 1

For evaluating the effectiveness of the blocked photographic reagents of the present invention and comparison compounds, the following samples were prepared. That is, each of Samples A to H was prepared by coating on a cellulose triacetate film support having a subbing layer the silver halide emulsion layer (1) and the protective layer (2) shown below. In this case, the blocked photographic reagent (precursor of an untifoggant) in this invention or the comparison antifoggant was incorporated in the silver halide emulsion by dissolving the precursor or antifoggant in tricresyl phosphate together with coupler (Cp-1) and dispersing the solution in the silver halide emulsion. The precursors and the fogging agents are shown in Table 1 together with the coated amounts thereof (g/m$^2$ or mole/m$^2$).

(1) Silver halide emulsion layer:

Layer containing $1.6\times10^{-2}$ mole/m$^2$ (as silver) of a negative-working silver iodobromide emulsion (mean gain size 1.4 μm), $1.33\times10^{-3}$ mole/m$^2$ of magenta coupler (Cp-1), the antifoggant or the precursor of this invention (shown in Table 1), and 2.50 g/m$^2$ of gelatin.

(2) Protective layer:

Layer containing 1.30 g/m$^2$ of gelatin and 0.05 g/m$^2$ of 2,4-dichloro-6-hydroxy-s-triazine sodium salt.

Each of these film samples was allowed to stand for 14 hours at 40° C. and 70% in relative humidity and after applying thereto an image exposure for sensitometry, the sample was subjected to the following color development process.

| Color development steps | Time | Temp. |
|---|---|---|
| 1. Color development | 3 min. 15 sec. | 38° C. |
| 2. Bleach | 6 min. 30 sec. | " |
| 3. Wash | 2 min. | " |
| 4. Fix | 4 min. | " |
| 5. Wash | 4 min. | " |
| 6. Stabilization | 1 min. | " |

The compositions of the processing solutions used in the aforesaid color development steps were as follows:

| Color Developer: | |
|---|---|
| Water | 800 ml |
| 4-(N—Ethyl-N—hydroxyethyl)-amino-2-methylaniline.sulfate | 5 g |
| Sodium Sulfite | 5 g |
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium nitrilotriacetate | 1.2 g |
| Water to make | 1 liter |
| | (pH 10.1) |

-continued

| | |
|---|---|
| Bleach Solution: | |
| Water | 800 ml |
| Ethylenediaminetetraacetic Acid Iron(III) Ammonium | 100 g |
| Ethylenediaminetetraacetic Acid Di-sodium | 10 g |
| Potassium Bromide | 150 g |
| Acetic Acid | 10 g |
| Water to make | 1 liter (pH 6.0) |
| Fix Solution: | |
| Water | 800 ml |
| Ammonium Thiosulfate | 150 g |
| Sodium Sulfite | 10 g |
| Sodium Hydrogensulfite | 2.5 g |
| Water to make | 1 liter (pH 6.0) |
| Stabilization Solution: | |
| Water | 800 ml |
| Formalin (37%) | 5 ml |
| Fuji Drywell* | 3 ml |
| Water to make | 1 liter. |

*trademark for surfactant agent made by Fuji Photo Film Co., Ltd.

The photographic properties of the samples thus processed are shown in Table 1.

The couplers and the comparison fogging agents used for the above-described sample films are shown below.

Cp-1

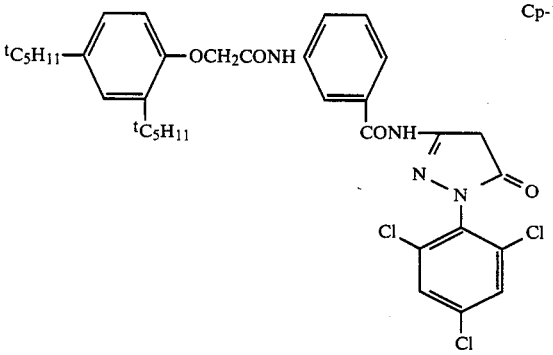

A-1

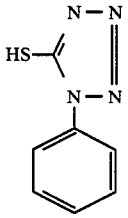

-continued

A-2

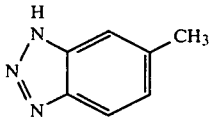

A-3

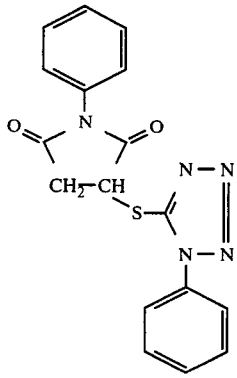

(A-3 is a precursor described in U.S. Pat. No. 3,888,677)

TABLE 1

| Sample | | Precursor of the Present Invention and Comparison Antifoggant | (mol/m²) | Fog | Gamma | Relative sensitivity* | Maximum Coloring Density |
|---|---|---|---|---|---|---|---|
| A | (Control) | — | — | 0.12 | 0.81 | 100 | 1.63 |
| B | (This invention) | (1) | $1.1 \times 10^{-5}$ | 0.07 | 0.75 | 94 | 1.50 |
| C | (This invention) | (6) | $1.1 \times 10^{-5}$ | 0.06 | 0.75 | 92 | 1.47 |
| D | (This invention) | (20) | $2.2 \times 10^{-5}$ | 0.08 | 0.77 | 95 | 1.57 |
| E | (This invention) | (5) | $1.1 \times 10^{-4}$ | 0.07 | 0.81 | 99 | 1.62 |
| F | (Comparison Example) | A-1 | $2.2 \times 10^{-6}$ | 0.05 | 0.41 | 27 | 0.94 |
| G | (Comparison Example) | A-2 | $2.2 \times 10^{-5}$ | 0.08 | 0.62 | 51 | 1.33 |
| H | (Comparison Example) | A-3 | $1.1 \times 10^{-5}$ | 0.07 | 0.73 | 76 | 1.27 |

*Relation sensitivity: The reciprocal of the exposure amount giving a coloring density fog +0.2 in the case of defining that of the control sample being 100.

From the results shown in Table 1, it is clear that in Samples B–E using the blocked photographic reagents (precursors) in this invention the formation of fog is effectively inhibited, without being accompanied by reductions in gamma, sensitivity, and maximum coloring density.

EXAMPLE 2

Each of Sample B of this invention and Sample H (the sample containing the comparison precursor) prepared in Example 1 was stored for one week at 40° C. at 80% RH and image-exposed and developed as in Example 1. In this case, the gamma, sensitivity and maximum coloring density were greatly reduced in Sample H as compared to Sample B.

From the results, it can be seen that the comparison precursor used in Sample H is liable to release the blocking group during storage and thus is lacking in stability, while the precursor in this invention shows high stability during storage.

EXAMPLE 3

An aqueous solution of 1 kg of silver nitrate and an aqueous solution of 210 g of potassium bromide and 290 g of sodium chloride were simultaneously added to an aqueous solution of 70 g of gelatin at a constant speed over a period of 30 minutes. Then, after removing soluble salts, gelatin was added to the mixture and then a gold sensitization and a sulfur sensitization were applied to the mixture to provide a silver chlorobromide emulsion (mean grain size 0.27 μm, Br 30 mole%). To the emulsion was added 4-hydroxy-6-methyl-1,3,3a-7-tetraazaindene as a stabilizer.

To the silver halide emulsion was added each of the blocked photographic reagents (precursors of untifogging agent) in this invention and the comparison precursor shown in Table 2. Then, a hardening agent, 1-hydroxy-3,5-dichlorotriazine sodium salt and a coating aid, sodium dodecylbenzenesulfonate were added to the emulsion and the resultant mixture was coated on a polyethylene terephthalate film at a silver coverage of 4.2 g/m$^2$.

Each of the film samples thus prepared was exposed through an optical wedge using a xenon flash light for $10^{-5}$ sec., developed with the developer having the following composition for 4 minutes at 27° C., and after stopping the development and fixing, the sample was washed and dried. The density of the image thus formed was measured using a P-type densitometer, made by Fuji Photo Film Co., Ltd., to measure the sensitivity and fog value. The standard point of the optical density for determining the sensitivity was fog +0.5. The results thus obtained are shown in Table 2 below.

| Composition of Developer: | |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metabisulfite | 1.5 g |
| Water to make | 1 liter. |

TABLE 2

| | Sample No. | Precursor | Amount (mol/Kg of emulsion) | Fog | Sensitivity |
|---|---|---|---|---|---|
| 1 | (Control) | — | — | 0.07 | 100 (standard) |
| 2 | (This invention) | (1) | $3 \times 10^{-4}$ | 0.05 | 93 |
| 3 | (This invention) | (2) | " | 0.05 | 94 |
| 4 | (This invention) | (6) | " | 0.04 | 88 |
| 5 | (This invention) | (13) | " | 0.05 | 92 |
| 6 | (This invention) | (15) | " | 0.04 | 89 |
| 7 | (This invention) | (18) | " | 0.05 | 87 |
| 8 | (This invention) | (20) | " | 0.05 | 89 |
| 9 | (Comparison Sample) | A-1 | " | 0.05 | 49 |

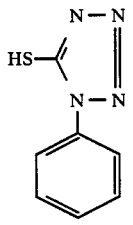

Comparison Compound A-1

From the results shown in Table 2, it can be seen that in the samples of this invention, the formation of fog can be inhibited with very little reduction in sensitivity as compared to the comparison sample using Comparison Compound A-1.

EXAMPLE 4

A silver halide emulsion containing 80 mole% silver chloride, 19.5 mole% silver bromide, and 0.5 mole% silver iodide was subjected to a gold sensitization and a sulfur sensitization. The mean grain size of the silver halide grains in the silver halide emulsion was 0.31 μm.

To 1 kg each of the silver haldie emulsion thus prepared was added each of the blocked photographic reagents (untifoggant) and comparison compounds shown in Table 3 and after further adding thereto 0.1 g of 3-carboxymethyl-5-(3-ethyl-2-thiazolidinilidene-thylidene)rhodanine (spectral sensitizer), 0.18 g of 4-hydroxy-6-methyl-1,3,3a,7-tetraazaindene (stabilizer), 0.45 g of polyalkylene oxide compound (P-21), 1.2 g of sodium dodecylbenzenesulfonate (surface active agent), 0.48 g of mucochloric acid (hardening agent), and 30 g of the polymer latex described in the production formula 3 of Japanese Patent Publication No. 5331/70, the resultant mixture was coated on a polyethylene terephthalate film base at a silver coverage of 3.9 g/m$^2$ to provide each sample of photographic films.

Each of the samples thus obtained was exposed to tungsten light (color temperature of 5400° C.) through a step wedge having a stage difference of 0.1 (logE) in contact with a negative grey contact screen (150 line-/inch, made by Dainippon Screen Mfg., Co., Ltd.) for one sec. Then, the sample was developed by means of an automatic processor using a lithographic developer having the composition shown below for 100 sec. at 27° C., and after stopping and fix, the sample was dried.

For the image of the sample thus obtained, the 10% dot, 50% dot, and 90% dot areas were measured and the sensitivity was obtained from the reciprocal of the exposure amount required for obtaining 50% dot. Also, from the difference between the logalithm of the exposure amount required for obtaining 10% dot and the logalithm of the exposure amount required for obtaining 90% dot, the dot gradation was obtained. The results thus obtained are shown in Table 3 below.

| Composition of Developer: | |
|---|---|
| Hydroquinone | 15 g |
| Addition product of formaldehyde and sodium bisulfite | 50 g |
| Potassium Carbonate | 30 g |
| Sodium Sulfite | 2.5 g |
| Potassium Bromide | 2.0 g |
| Boric Acid | 5.0 g |
| Sodium Hydroxide | 3.0 g |
| Triethylene Glycol | 40 g |
| EDTA.2Na | 1.0 g |
| Water to make | 1 liter |

TABLE 3

| | Sample No. | Precursor | Amount (mol/kg of emulsion) | Sensitivity | Fog | Dot Gradation |
|---|---|---|---|---|---|---|
| 1 | (Control) | | | 100 (Standard) | 0.06 | 0.9 |
| 2 | (This invention) | (6) | $2 \times 10^{-4}$ | 97 | 0.04 | 1.0 |
| 3 | (This invention) | " | $4 \times 10^{-4}$ | 92 | 0.04 | 1.1 |
| 4 | (Comparison Example) | A-1 | $2 \times 10^{-4}$ | 49 | 0.04 | 1.0 |
| 5 | (Comparison Example) | " | $4 \times 10^{-4}$ | 38 | 0.04 | 1.1 |
| 6 | (This invention) | (8) | $2 \times 10^{-4}$ | 96 | 0.04 | 1.1 |
| 7 | (This invention) | " | $4 \times 10^{-4}$ | 91 | 0.04 | 1.2 |
| 8 | (Comparison Example) | A-4 | $2 \times 10^{-4}$ | 47 | 0.04 | 1.1 |
| 9 | (Comparison Example) | " | $4 \times 10^{-4}$ | 36 | 0.04 | 1.2 |

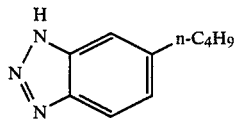

Comparison Compound A-4

From the results shown in Table 3 above, it can be seen that in the samples of this invention, the formation of fog can be inhibited without substantially reducing the sensitivity and at the same time the dot gradation can be prolonged without substantially reducing the sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer having associated therewith at least one blocked photographic reagent represented by formula (I) or (II):

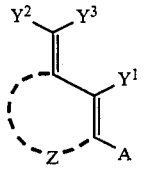

(I)

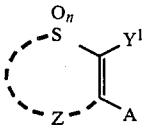

(II)

wherein, A represents a moiety of a photographic reagent or a moiety of a precursor of a photographic reagent bonded to the ring containing Z through a hetero atom; $Y^1$, $Y^2$ and $Y^3$ each represents a hydrogen atom or a substituent or $Y^1$ and $Y^3$ in formula (I) together form a ring; Z represents an atomic group necessary for forming a carbon ring or a heterocyclic ring; and n represents 1 or 2.

2. A silver halide photographic material as in claim 1, wherein said hetero atom is selected from a group consisting of S, O, N and P.

3. A silver halide photographic material as in claim 1, wherein said blocked photographic reagent is a compound represented by formula (I') or (II')

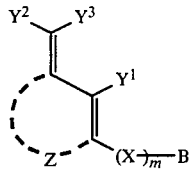

(I')

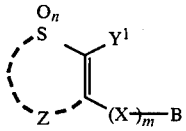

(II')

wherein, B represents a moiety of a photographic reagent bonded to X through a hetero atom; X represents a divalent linkage group bonded through a hetero atom to the ring containing Z; m represents 0 or 1; $Y^1$, $Y^2$ and $Y^3$ each represents a hydrogen atom, a halogen atom, an alkyl group, an alkenyl group, an aryl group, an alkoxy group, an aryloxy group, an alkylthio group, an arylthio group, an acyloxy group, a carbonic acid ester group, an amino group, a carbonamido group, a ureido group, a carboxy group, an oxycarbonyl group, a carbamoyl group, an acyl group, a sulfo group, a sulfonyl group, a sulfinyl group, a sulfamoyl group, a cyano group, or a nitro group; and Z represents an atomic group necessary for forming a carbocyclic ring or a heterocyclic ring.

4. A silver halide photographic material as in claim 2, wherein B is a moiety of a photographic reagent derived from an antifoggant, a development restrainer, a developing agent, an auxiliary developing agent, a fogging agent, a silver halide solvent, a bleach accelerator, a dye, and a photographic reagent having a redox function of releasing the above-described photographic reagent.

5. A silver halide photographic material as in claim 2, wherein said linkage group is selected from the group consisting of a linkage group releasing B by an intramolecular ring closing reaction, a linkage group releasing B by an intramolecular electron transfer, a linkage group releasing B with the elimination of carbon dioxide, and a linkage group releasing B with the elimination of formaldehyde.

6. A silver halide photographic material as in claim 2, wherein said divalent linkage represented by X is selected from the group consisting of

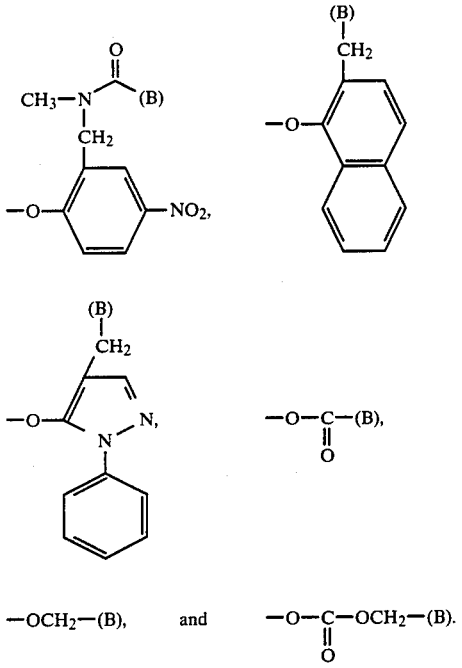

7. A silver halide photographic material as in claim 1, wherein said blocked photographic reagent is selected from the group consisting of compounds represented by formulae

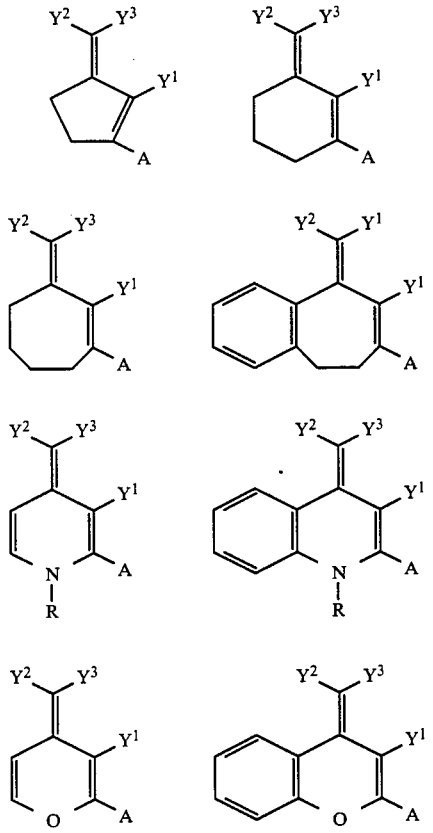

-continued

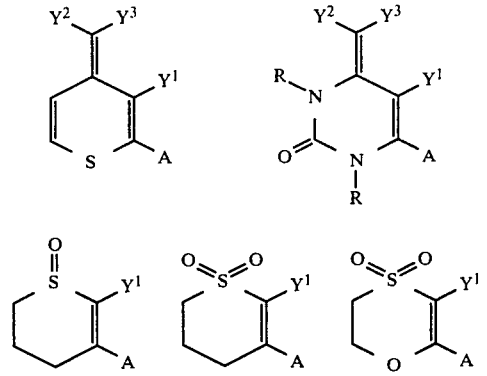

wherein $Y^1$, $Y^2$, $Y^3$ and A are defined as in formulae (I) and (II), and R represents a hydrogen atom, an alkyl group, an aryl group, an acyl group, an oxycarbonyl group, carbamoyl group, an sulfonyl group, and a sulfinyl group; and blocked photographic reagents having one or more substituents on the carbocyclic ring or the heterocyclic ring in addition to R, $Y^1$ and A in these formulae.

8. A silver halide photographic material as in claim 7, wherein said substituent on the carbocyclic ring or the heterocyclic ring is a substituent selected from the group consisting of a halogen atom, an alkyl group, aryl group, an alkoxy group, an aryloxy group, an alkylthio group, an arylthio group, an acyl group, an acylamino group, a nitro group, a cyano group, an oxycarbonyl group, a hydroxy group, a carboxy group, a sulfo group, a ureido group, a sulfonamido group, a sulfamoyl group, a carbamoyl group an acyloxy group, an amino group, a carbonic acid ester group, a sulfonyl group, and a sulfinyl group.

9. A silver halide photographic material as in claim 1, wherein said blocked photographic reagent is incorporated in a silver halide emulsion layer a dye providing compound-containing layer, a subbing layer, a protective layer, an interlayer, a filter layer, an antihalation layer, an image-receiving layer, a coversheet layer. a white reflecting layer, a neutralizing layer, or a neutralization timing layer.

10. A silver halide photographic material as in claim 1, wherein the silver halide photographic material is a silver halide photographic printing material, a color photographic material in coupler system, a material for the system by silver dye blocking process, a black-and-white photographic material, or a color diffusion transfer photographic material.

11. A silver halide photographic material as in claim 4, wherein the blocked photographic reagent having a moiety derived from an antifoggant or a development restrainer is contained in an amount of from $10^{-8}$ to $10^{-1}$ mole per mole of silver in the silver halide emulsion.

12. A silver halide photographic material as in claim 4, wherein the blocked photographic reagent having a moiety derived from a developing agent is contained in an amount of from $10^{-2}$ to 10 moles per mole of silver in the silver halide emulsion.

13. A silver halide photographic material as in claim 4, wherein the blocked photographic reagent having a moiety derived from a pyrazolidone-series auxiliary developing agent is contained in an amount of from $10^{-4}$ to $10^{-6}$ mole per mole of silver in the silver halide emulsion.

14. A silver halide photographic material as in claim 4, wherein the blocked photographic reagent having a moiety derived from a fogging agent is contained in an amount of from $10^{-2}$ to $10^{-6}$ mole per mole of silver in the silver halide emulsion.

15. A silver halide photographic material as in claim 4, wherein the blocked photographic reagent having a moiety derived from a silver halide solvent is contained in an amount of from $10^{-3}$ to 10 moles per mole of silver in the silver halide emulsion.

16. A silver halide photographic material as in claim 4, wherein the blocked photographic reagent having a moiety derived from a bleach accelerator is contained in an amount of from $10^{-5}$ to 0.1 mole per mole of silver in the silver halide emulsion.

17. A silver halide photographic material as in claim 4, wherein the blocked photographic reagent having a moiety derived from a dye or a dye-providing compound is contained in an amount of from $10^{-3}$ to 1 mole per mole of silver in the silver halide emulsion.

18. A silver halide photographic material as in claim 1, wherein said blocked photographic reagent is represented by formula (I).

19. A silver halide photographic material as in claim 1, wherein said blocked photographic reagent is represented by formula (II).

20. A silver halide photographic material as in claim 3, wherein said blocked photographic reagent is represented by formula (I').

21. A silver halide photographic material as in claim 3, wherein said blocked photographic reagent is represented by formula (II').

* * * * *